US005221005A

United States Patent [19]

Hayward

[11] Patent Number: 5,221,005

[45] Date of Patent: Jun. 22, 1993

[54] RESTRAINING DEVICE FOR TAB CARRIER MAGAZINES

[75] Inventor: James L. Hayward, Sunnyvale, Calif.

[73] Assignee: Advanced Micro Devices, Inc., Sunnyvale, Calif.

[21] Appl. No.: 874,899

[22] Filed: Apr. 29, 1992

[51] Int. Cl.[5] ..... B65D 85/42; B65D 81/04; B65D 81/08

[52] U.S. Cl. ..... 206/334; 206/499; 206/814; 206/817; 206/591; 206/535

[58] Field of Search ..... 206/814, 817, 334, 591, 206/445, 499, 535, 536, 537

[56] References Cited

U.S. PATENT DOCUMENTS

| | | | |
|---|---|---|---|
| 2,159,262 | 5/1939 | Feiss | 206/817 |
| 2,937,745 | 5/1960 | Wilson | 206/591 |
| 3,032,179 | 5/1962 | Menolasino et al. | 206/445 |
| 4,215,786 | 8/1980 | Vertes | 206/591 |
| 4,353,481 | 10/1982 | Tando | 206/328 |
| 4,415,083 | 11/1983 | Kemkers | 206/334 |

*Primary Examiner*—William I. Price
*Attorney, Agent, or Firm*—Davis Chin

[57] ABSTRACT

A restraining device (10 or 10*a*) adapted for holding slide carriers (14) immovable in magazines includes a top wall panel (34), at least two horizontal pleated panel sections (36*a*–36*d*), and a bottom wall panel (38) all joined together to define a hollow bellows-type structure.

13 Claims, 2 Drawing Sheets

RESTRAINING DEVICE FOR TAB CARRIER MAGAZINES

BACKGROUND OF THE INVENTION

This invention relates generally to packing devices and more particularly, it relates to an improved restraining device or insert, used with magazines which are partially filled with TAB slide carriers, for holding the slide carriers immovable in the magazines against undesirable free movement therein.

As is generally known in the semiconductor technology industry, magazines are used to hold and store a plurality of TAB slide carriers during handling and shipment. Each of the slide carriers is used to hold a COT (chip-on-tape) component in it. The COT component utilizes TAB (tape-automated bonding) as the interconnect method and a semiconductor chip or die is bonded into a TAB tape site. The carrier magazines are generally formed of a tubular configuration having a removable cap at each end thereof and have become standardized to hold a specific number of the TAB slide carriers. For example, the carrier magazines are designed to hold 100 carriers of the 35 mm version and to hold 50 carriers of the 48 and 50 mm versions in a stacked position.

In practice, however, the carrier magazines may well be holding less than the maximum number required to fill them. As a result, there is created a void or gap in the filling of the magazines which allows the carriers contained therein to move out of their normal stacked position. Since the semiconductor dies are so intricate and delicate, such physical movement may render them to be susceptible to mechanical damage. Further the semiconductor dies can also be damaged or destroyed by electrostatic discharge (ESD) due to a rapid discharge of a charged condition.

To date, the prior art solutions to this problem have involved the use of various types of rubber-like plugs for filling the gap left in the carrier magazines. However, these prior art plugs have the disadvantage in that they may come in contact with the tape or the semiconductor dies, resulting in potential damage. While protection from such plugs could be provided by including one or more empty slide carriers inserted into the magazine, this would necessitate subsequent manufacturing equipment to identify these extra carriers, thus increasing manufacturing costs. Further, these prior art plugs suffer from the disadvantage in that they must be fashioned to different sizes for each specific quantity of slide carriers filling the magazines, thereby making assembly inefficient and expensive. For instance, there is shown in FIG. 1 a rubber-like strip 2 of the prior art which is folded into a U-shape and then inserted into a partially-filled carrier magazine 4 (FIG. 2). Finally, an end cap 6 is placed over its opened end. Each time the number of slide carriers to be placed inside of the magazine is changed, the strip 2 must be cut to a new different length and folded for insertion into the partially-filled carrier magazine. As can be seen, this is a very tedious and time-consuming procedure.

It would therefore be desirable to provide an improved restraining device for holding slide carriers in a magazine against undesirable free movement therein. Further, it would be expedient that the restraining device be compressible so as to accommodate a wide variation in the number of carriers to be placed in the magazine.

SUMMARY OF THE INVENTION

Accordingly, it is a general object of the present invention to provide an improved restraining device for holding slide carriers in a magazine which is relatively simple and economical to manufacture and assemble.

It is an object of the present invention to provide an improved restraining device for holding slide carriers in a magazine against undesirable free movement therein and for simultaneously cushioning the slide carriers with COT components against shock and possible damage during commercial handling and shipment.

It is another object of the present invention to provide an improved restraining device for supporting the slide carriers against longitudinal displacement relative to the axis of the carrier magazine.

It is still another object of the present invention to provide an improved restraining device for holding slide carriers in a magazine which is formed of a top wall panel, at least two horizontal pleated panel sections, and a bottom wall panel all joined together to define a hollow bellows-type structure.

It is still yet another object of the present invention to provide an improved restraining device which is made of an inexpensive material and construction, but yet is relatively durable and re-usable.

In accordance with these aims and objectives, the instant invention is concerned with the provision of an improved TAB carrier magazine with a restraining device which includes a substantial rectangularly-shaped tubular body member, a lower end cap, and an upper end cap. The tubular body member has a first end and a second end. The lower end cap is secured to the first end of the tubular member. A plurality of slide carriers are disposed in the interior of the tubular member to fill partially the same. Each of the slide carriers contains a COT component. The upper end cap is secured to the second end of the tubular body member.

The restraining device is disposed between the uppermost one of the plurality of slide carriers and the upper end cap for holding the plurality of slide carriers immovable in the tubular body member against undesirable free movement therein. The restraining device is formed of a top wall panel, at least two horizontal pleated panel sections, and a bottom wall panel all joined together to define a hollow bellows-type structure. As a result, shock and potential damage to the COT components during handling and shipment have been eliminated.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
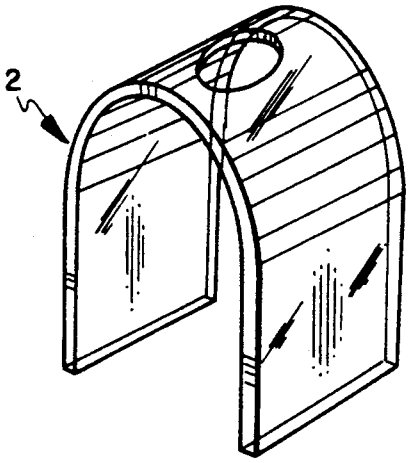
FIG. 1 (PRIOR ART)
FIG. 1 is a perspective view of a rubber-like strip of the prior art.
Figure 2:
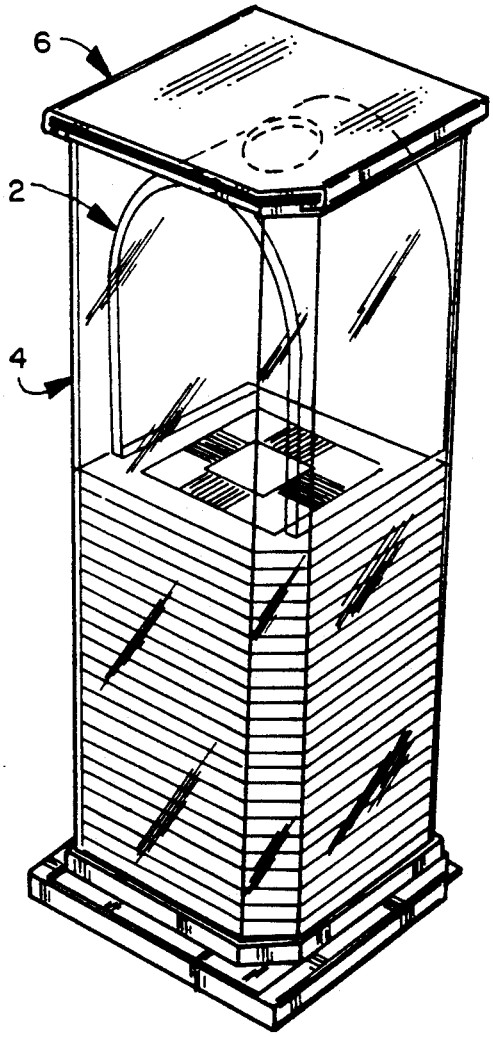
FIG. 2 (PRIOR ART)
FIG. 2 is a perspective view of a partially-filled carrier magazine, employing the prior art strip of FIG. 1.
Figure 3:
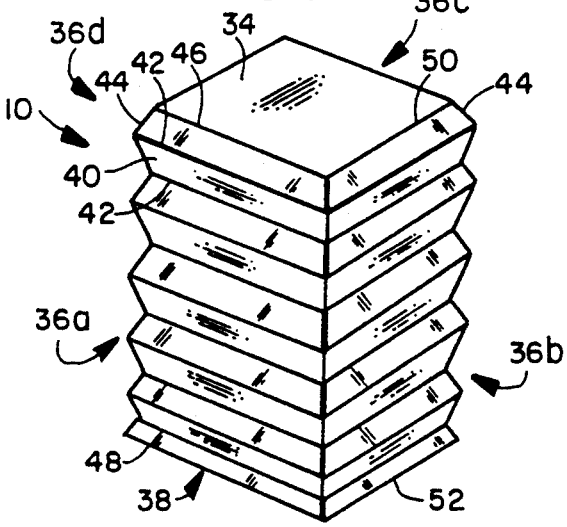
FIG. 3 is perspective view of a restraining device, constructed in accordance with the principles of the present invention.
Figure 4:
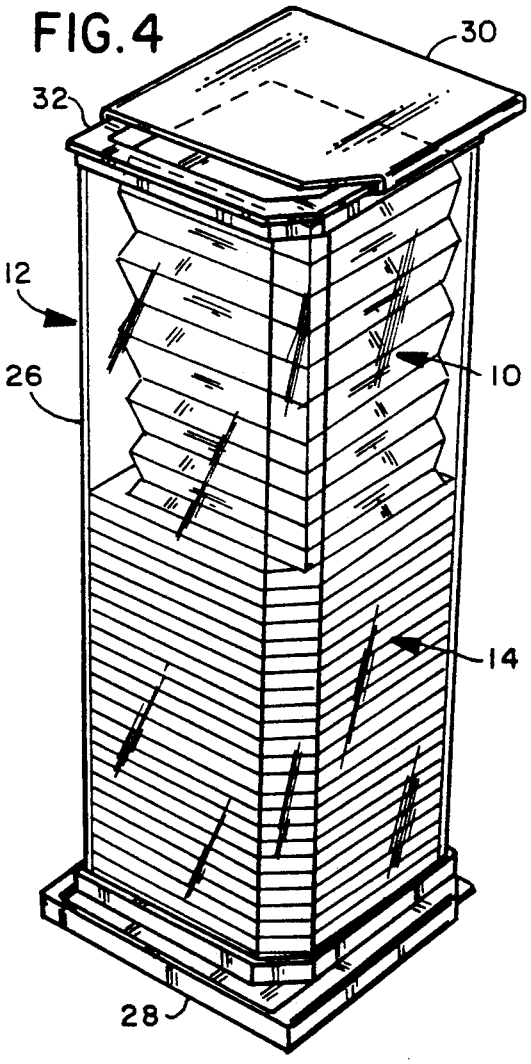
FIG. 4 is a perspective view of a partially-filled carrier magazine, employing the present restraining device of FIG. 3.
Figure 7:
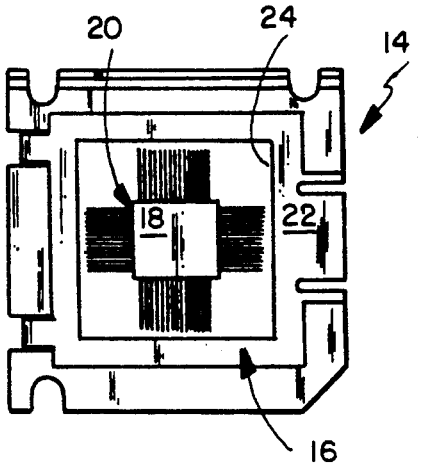
FIG. 7 is a perspective view of a TAB slide carrier housing a COT component.

Referring now in detail to the drawings, there is shown in FIG. 3 a restraining device or insert designated generally by the reference numeral and constructed in accordance with the principles of the present invention. The restraining device 10 of the present invention is used in conjunction with a TAB carrier magazine 12 of FIG. 4 which has been partially filled with TAB slide carriers 14. Each of the slide carriers 14 (one of which is illustrated in FIG. 7) is of a substantially rectangular shape and is used to hold a COT (chip-on-tape) component 16 in its central portion thereof. The COT component utilizes the tape-automated bonding (TAB) as the interconnect method and an integrated circuit semiconductor chip or die 18 is bonded into a TAB tape site 20. As can be seen, the die 18 is disposed below the upper surface area 22 of the slide carrier in the central opening 24 thereof.

The TAB carrier magazine 12 is comprised of a rectangularly-shaped tubular body member 26, a lower end cap 28, and an upper end cap 30. While the tubular body member 26 may be of various dimensions, the sidewalls thereof are formed so as to conform to the contour of the slide carrier and the length thereof is such that the quantity of slide carriers contained therein is a predetermined maximum number, for example, 100 or 50. However, since it is often impractical for the customer to order the COT components in only exact multiples of that quantity, there has arisen the need for a restraining device of the present invention which serves to hold the slide carriers 14 in the partially-filled carrier magazine 12 against undesirable movement therein and to simultaneously cushion the slide carriers with the COT components against shock and possible damage during commercial handling and shipment to the customer.

It will be noted that each end of the tubular body member 26 is provided with a rectangularly-shaped mounting flange 32 (one of which is shown). The upper and lower end caps 28 and 30 are adapted to be slidably engageable with the flanges 32. In this manner, each end of the tubular body member can be opened and closed so as to facilitate loading of the slide carriers during production and to permit their subsequent removal by the customers.

The restraining device 10 is formed of a four-sided accordion-style configuration which includes a rectangularly-shaped top wall panel 34, a plurality (four) of horizontal pleated panel sections **36*a*–36*d*, and a rectangularly-shaped bottom wall panel 38 all joined together to define a hollow bellows-type structure. Each of the pleated panel sections 36*a*–36*d* includes a plurality of trapezoidal-shaped wall panels 40 which are connected serially by foldlines 42 along their horizontal parallel sides. Each of the remaining sides of the plurality of wall panels 40 is joined to a corresponding one of the other wall panels in the adjacent panel sections along diagonal foldlines 44**.

One end of the panel section **36*a* is joined to the top wall panel 34 along a foldline 46. The other end of the panel section 36*a* is joined to the bottom wall panel 38 along a foldline 48. Similarly, one end of the panel sections 36*b* is joined to the top wall 34 along a foldline 50, and the other end of the panel section 36*b* is joined to the bottom wall panel 38 along a foldline 52. The remaining panel sections 36*a* and 36*b* are likewise interconnected along corresponding foldlines between the top wall panel 34 and the bottom wall panel 38**.

The hollow bellows-like structure is sized so as to be slightly smaller than the opening in the ends of the carrier magazine. The hollow bellows-like structure may be formed of a number of suitable resilient materials, such as corrugated paperboard, heavy kraftboard, flexible plastic, and many other similar materials. For example, the plastic may be polyethylene, nylon, mylar, polypropylene or polyvinyl chloride. The restraining device 10 of the present invention is preferably fabricated from an elastomeric material such as rubber or other polymeric material.

In use, the lower end cap 28 is secured to the lower end of the tubular body member 26. A desired number of the slide carriers containing the COT component 16 is loaded into the tubular member so as to form the partially-filled carrier magazine. Next, the restraining device 10 is inserted in the tubular member so that the bottom wall panel 38 thereof contacts or engages only around the periphery of the uppermost slide carrier. Consequently, the COT component 16 contained in the uppermost slide carrier will not be damaged. Then, the top wall panel 34 is depressed so as to cause the horizontal pleated panel sections **36*a*–36*d* to be compressed. Finally, the upper end cap 30 is slidably mounted over the flange 32 so as to engage with the top wall panel 34 and to maintain the restraining device in a compressed condition. As a result, the upper end of the tubular member is closed by the upper end cap 30**.

It is an important feature of the restraining device 10 that it be compressible between the uppermost slide carrier and the inside surface of the upper end cap so as to allow the same length of the restraining device to be used for a wide variation in the number of slide carriers to be placed in the magazine. Therefore, a fewer number of restraining devices having different lengths will be required to be made so as to accommodate the various levels to which the magazine is filled that would be typically encountered in normal use. Further, the restraining device 10 is preferably made of a durable material so as to be re-usable.

Figure 5:
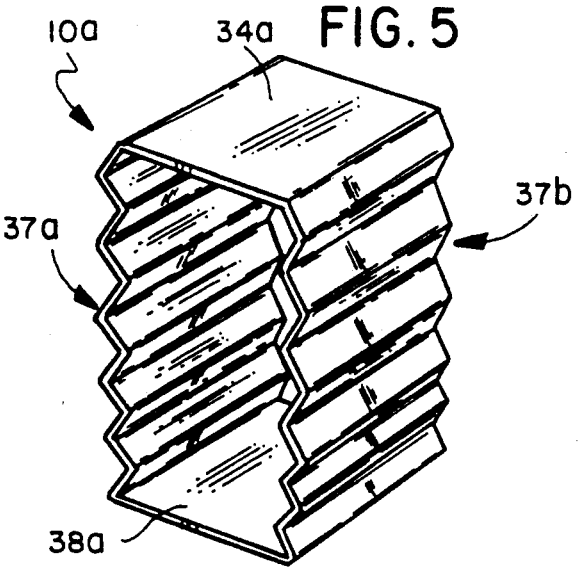
FIG. 5 is a second embodiment of a restraining device of the present invention.
Figure 6:
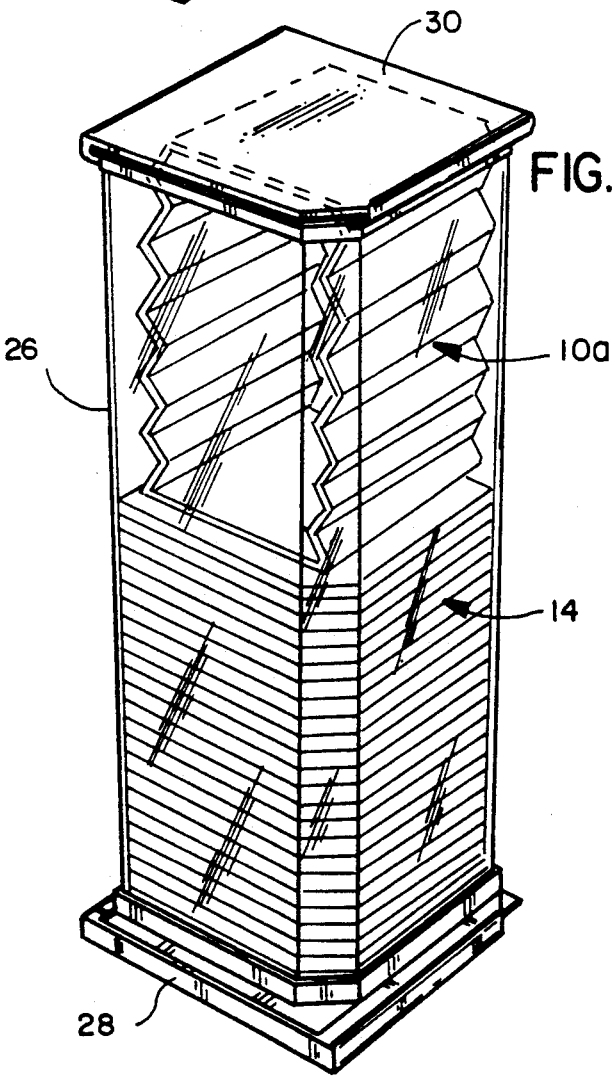
FIG. 6 is a perspective view of a partially-filled carrier magazine, employing the restraining device of FIG. 5.

In FIGS. 5 and 6, there is shown a second embodiment of the restraining device **10*a* of the present invention. By comparing FIGS. 5 and 3, it can be seen that the only difference is that two of the horizontal pleated panel sections in FIG. 3 have been eliminated in FIG. 5. Thus, the restraining device 10*a* is formed of a rectangularly-shaped top wall panel 34*a*, two oppositely disposed horizontal pleated panel sections 37*a* and 37*b*, and a rectangularly-shaped bottom wall panel 38 all connected together. Again, in use the bottom wall panel 38*a* will contactly engage the periphery of the uppermost slide carrier and the top wall panel 34*a* will contactly engage the inside surface of the upper end cap. Except for these differences, the assembly and operation of the restraining device 10*a* is identical to that described above with respect to the restraining device 10**.

It should be apparent to those skilled in the art that the top and bottom wall panels 34, 38 of FIG. 3 and the top and bottom wall panels 34*a*, 38*a* of FIG. 5 may be round, square, oval, or any other geometric shape than the rectangularly-shaped design illustrated in the drawings. Further, it should also be noted that the top and bottom wall panels may be provided with an opening therein rather than being completely solid. Moreover, in the embodiment of FIG. 3 the top and bottom wall panels 34, 38 may be eliminated from the hollow bellows-type structure 10 so as to be formed of only the four pleated panel sections 36*a*–36*d*.

From the foregoing detailed description, it can thus be seen that the present invention provides an improved restraining device for holding slide carriers immovable in magazines against undesirable free movement therein. Further, the restraining device simultaneously cushions the slide carriers with COT components against shock and possible damage during commercial handling and shipment. Moreover, the restraining device of the present invention is compressible so as to accommodate a wide variation in the number of slide carriers that can be placed inside the magazine.

While there has been illustrated and described what is at present considered to be preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out the invention, but that the invention will include all embodiments falling within the scope of the appended claims.

What is claimed is:

1. A TAB carrier magazine with a restraining device comprising:

a substantially rectangular-shaped tubular body member (26) having a first end and a second end;

a lower end cap (28) secured to said first end of said tubular member;

a plurality of slide carriers (14) disposed in the interior of said tubular member to fill partially the same, each slide carrier containing a COT component;

an upper end cap (30) secured to said second end of said tubular member;

said restraining device (10 or 10*a*) being disposed between the uppermost one of said plurality of slide carriers and said upper end cap for holding said plurality of slide carriers immovable in said tubular member against undesirable free movement therein;

said restraining device being formed of a top wall panel (34), at least two horizontal pleated panel sections (36*a*–36*d*), and a bottom wall panel (38) all joined together to define a hollow bellows-type structure; and each of said at least two horizontal pleated panel sections (36*a*–36*d*) being formed of a plurality of trapezoidal-shaped wall panels (40) which are connected serially by foldlines along their horizontal parallel sides, whereby shock and potential damage to said COT components during handling and shipment have been eliminated.

2. A carrier magazine as claimed in claim 1, wherein said restraining device is formed of a resilient material.

3. A carrier magazine as claimed in claim 1, wherein said restraining device is formed of a paperboard material.

4. A carrier magazine as claimed in claim 1, wherein said restraining device is formed of a flexible plastic material.

5. A carrier magazine as claimed in claim 1, wherein said restraining device is formed of an elastomeric material.

6. A carrier magazine as claimed in claim 1, wherein said top and bottom wall panels (34, 38) of said restraining device are rectangular in shape, and wherein there are four horizontal pleated panel sections (36*a*–36*d*) interconnected between said top and bottom wall panels.

7. A carrier magazine as claimed in claim 1, wherein said hollow bellows-type structure is sized so as to be slightly smaller than the interior of said tubular member.

8. A carrier magazine as claimed in claim 7, wherein said hollow bellows-type structure has its bottom wall panel (38) engaging only around the periphery of the uppermost slide carrier and its top wall panel (34) engaging the inside surface of said upper end cap so as to be compressible therebetween.

9. A restraining device adapted for holding slide carriers immovable in magazine comprising:

a top wall panel (34);

at least two horizontal pleated panel sections (36*a*–36*d*);

a bottom wall panel (38);

each of said at least two horizontal pleated panel sections being interconnected between said top wall panel and said bottom wall panel to define a hollow bellows-type structure; and each of said at least two horizontal pleated panel sections (36*a*–36*d*) being formed of a plurality of trapezoidal-shaped wall panels (40) which are connected serially by foldlines along their horizontal parallel sides.

10. A restraining device as claimed in claim 9, wherein said restraining device is formed of a resilient material.

11. A restraining device as claimed in claim 9, wherein said restraining device is formed of an elastomeric material.

12. A restraining device as claimed in claim 9, wherein said hollow bellows-type structure is sized so as to be slightly smaller than the interior of said magazine.

13. A restraining device as claimed in claim 12, wherein said hollow bellows-type structure has its bottom wall panel (38) engaging only around the periphery of the uppermost slide carrier and its top wall panel (34) engaging the inside surface of an upper end cap secured to the magazine so as to be compressible therebetween.

* * * * *

UNITED STATES PATENT AND TRADEMARK OFFICE

CERTIFICATE OF CORRECTION

PATENT NO. : 5,221,005

DATED : June 22, 1993

INVENTOR(S) : James L. Hayward

It is certified that error appears in the above-identified patent and that said Letters Patent is hereby corrected as shown below:

Column 3, line 16, after "numeral" insert --10--.

Signed and Sealed this

Third Day of May, 1994

Bruce Lehman

*Attest:*

BRUCE LEHMAN

*Attesting Officer*

*Commissioner of Patents and Trademarks*